US006899041B2

(12) United States Patent
Wark

(10) Patent No.: US 6,899,041 B2
(45) Date of Patent: May 31, 2005

(54) MULTI-SPIN MIXER FOR PARTICULATE COAL SUPPLY CONDUIT

(76) Inventor: Rickey E. Wark, 4 Watermark Way, The Woodlands, TX (US) 77381

( * ) Notice: Subject to any disclaimer, the term of this patent is extended or adjusted under 35 U.S.C. 154(b) by 0 days.

(21) Appl. No.: 10/417,560

(22) Filed: Apr. 17, 2003

(65) Prior Publication Data

US 2004/0206279 A1 Oct. 21, 2004

(51) Int. Cl.[7] ..... F23K 1/00; F23K 3/00

(52) U.S. Cl. ..... 110/106; 110/309; 110/310; 110/104 R; 110/101 R

(58) Field of Search ..... 241/187, 188.2, 241/261; 110/232, 222, 309, 310, 106, 104 R, 101 R; 209/143, 722; 239/424

(56) References Cited

U.S. PATENT DOCUMENTS 1,165,869 A * 12/1915 Fraser ..... 209/37
1,315,719 A * 9/1919 Grindle ..... 110/104 R
2,623,700 A * 12/1952 Scherer ..... 241/187
5,685,240 A * 11/1997 Briggs et al. ..... 110/106
5,873,156 A 2/1999 Wark
6,055,914 A 5/2000 Wark
6,186,079 B1 2/2001 Wark et al.
6,234,090 B1 5/2001 Wark et al.
6,257,415 B1 7/2001 Wark

* cited by examiner

*Primary Examiner*—Kenneth Rinehart
(74) *Attorney, Agent, or Firm*—Young & Basile, P.C.

(57) ABSTRACT

A mixer having two or more concentric cylindrical flow channels is placed in a supply conduit for a combustion chamber to mix airborne particulate coal prior to entering a manifold supplying four parallel branch conduits. Vanes are mounted in the mixer channels for imparting spin to the coal/air flow. The spin direction in one channel is opposite the spin direction of the adjacent channels(s). A turbulence-producing transition section is located downstream of the mixer.

20 Claims, 4 Drawing Sheets

MULTI-SPIN MIXER FOR PARTICULATE COAL SUPPLY CONDUIT

FIELD OF THE INVENTION

This invention relates to systems for supplying airborne particulate coal to the combustion chamber of a coal-fired boiler of the type used to generate steam for turbines in an electric utility plant, and more particularly to a mixer device for reducing or eliminating non-uniform flow rates in parallel supply conduits located between a pulverizer and a combustion chamber.

BACKGROUND OF THE INVENTION

It is well known to feed combustion chambers for turbine generator boilers with airborne particulate coal; structures for carrying out this function are commonly found in electric utility plants throughout the United States and Canada. It is common in these systems to use a main supply conduit to receive particulate coal from a pulverizer/classifier. It is also common to divide the main supply conduit into several parallel branches which are connected to spaced points around the combustion chamber.

A problem which arises in systems of the type described above is ensuring that the branch conduits exhibit at least approximately equal coal flow rates so that the fireball in the combustion chamber is stabilized as to size and location within the combustion chamber. The flow of particulate coal through parallel branch conduits of different lengths and configurations tends to be unstable and inherently non-uniform. Many devices have been created to deal with this problem; see, for example, U.S. Pat. Nos. 5,873,156, 6,055,914, 6,186,079, 6,257,415 and 6,234,090.

SUMMARY OF THE INVENTION

The present invention is, according to one aspect, a mixer for use in a coal-fired combustion chamber supply conduit, typically the main supply conduit downstream of a pulverizer, the effect of which is to promote uniformity in the rate of flow of airborne particulate coal from the main supply conduit to the various branches of a parallel branch feed system. In general, the invention comprises a mixer comprising a plurality of substantially concentric walls, typically but not necessarily cylindrical and made of a wear-resistant material such as steel or a steel alloy, defining at least two substantially concentric annular flow channels receiving airborne particulate coal from a source such as a pulverizer/classifier. The two channels may be referred to as "inner" and "outer" channels but it is to be understood that there may be three, four or more such concentric channels in a particular embodiment. In the case of three channels, they are referred to as "inner," "intermediate" and "outer" channels. A first plurality of circumferentially spaced vanes are located in the outer flow channel and are oriented to impart a clockwise spin to the airborne particulate coal flowing therethrough. A second plurality of circumferentially spaced vanes are located in the inner flow channel to impart a counterclockwise spin to the airborne particulate coal flowing therethrough.

In the above description as well as throughout this document, the terms "clockwise" and "counterclockwise" are used only in a relative sense to make it clear that the flow in one of the annular flow channels spins or rotates around the axis of the supply conduit in a direction which is opposite to the spin or rotation of flow in the adjacent annular flow channel or channels.

The mixer may be fabricated as an integral part of the supply conduit or made in the form of an insert which can be removed for servicing or replacement.

In the preferred embodiment hereinafter described in detail, there are three or more annular and concentric flow channels defined by cylindrical walls and consisting of at least an outer flow channel, an intermediate flow channel and an inner flow channel. The cross-sectional areas of all of the flow channels are at least approximately the same. To achieve this, the radial spacing between the walls of the outermost flow channel is less than the radial spacing between the walls of the innermost flow channel. The vanes in these channels are located in an overlapping fashion so there is no straight path for coal particulates to follow through the mixer.

The mixer may optionally be combined with other, downstream turbulence-causing features as hereinafter described.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
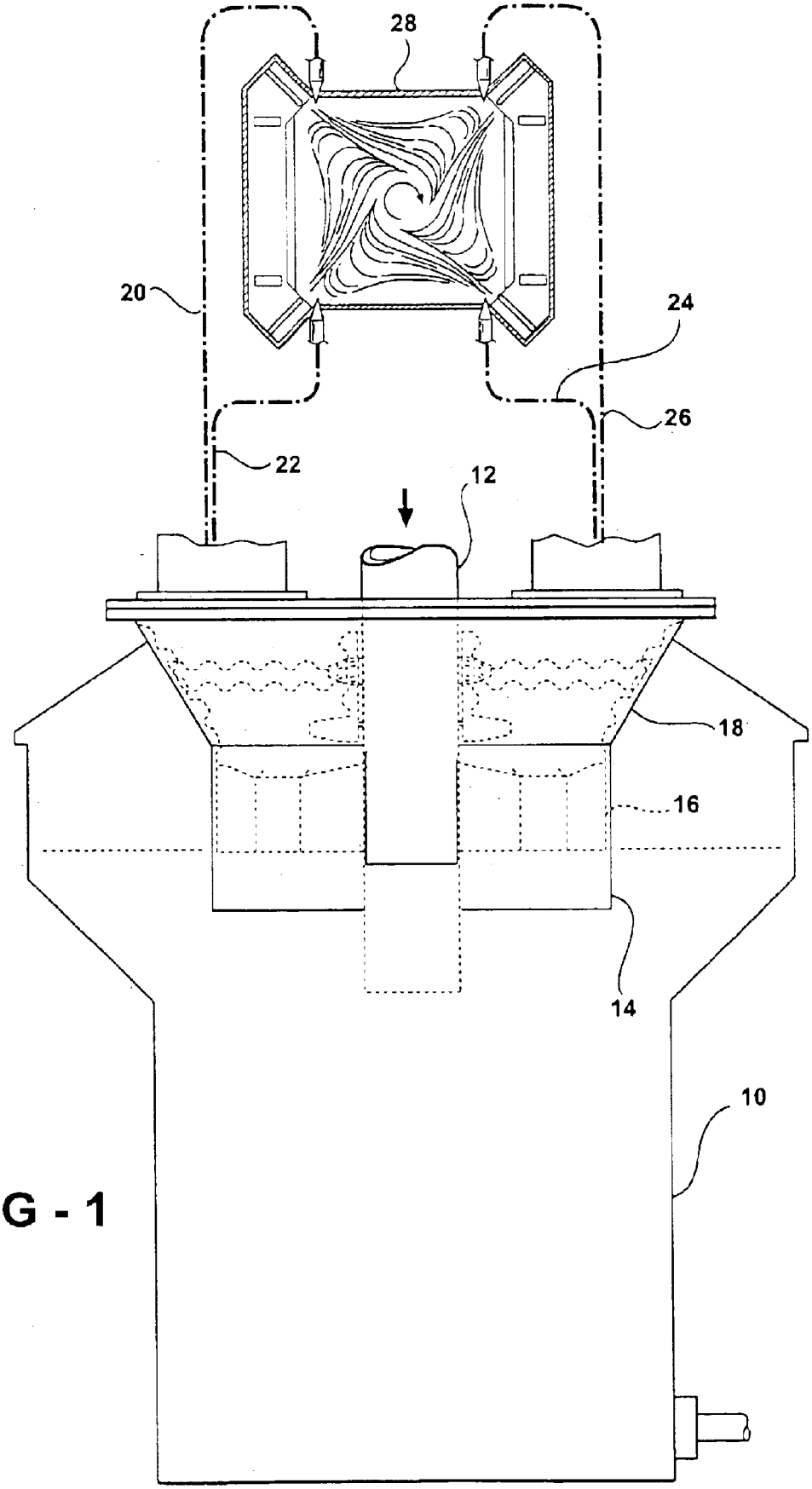
FIG. 1 is a diagram of a complete system for supplying pulverized and classified airborne particulate coal to a combustion chamber through a main supply conduit and a manifold section having four branches.

Referring first to FIG. 1, a conventional coal pulverizer/classifier 10 is shown to have a central vertical coal inlet supply conduit 12 for feeding lump coal into the pulverizer/classifier in controlled quantities. The pulverizer/classifier 10 comprises a main outlet supply conduit 14 which, in the illustrated embodiment, is concentric with the inlet supply conduit 12 but substantially larger in diameter. Some pulverizers have side feed features in which case the conduit 12 serves as a center outflow channel with or without vanes. Alternatively, it can be blocked off. A mixer insert 16 is located in the outlet supply conduit 14 as better shown in FIGS. 2–4. The outlet supply conduit 14 merges into a frustoconical transition section 18 which acts as a manifold to supply airborne particulate coal to four parallel branch conduits 20, 22, 24, 26 which are arranged in the fashion disclosed in my prior patents listed above to supply the four corners of a combustion chamber 28 which is associated with a boiler for supplying steam to the turbine of an electrical power generator. The transition section 18 may be straight-sided; i.e., substantially cylindrical.

Figure 2:
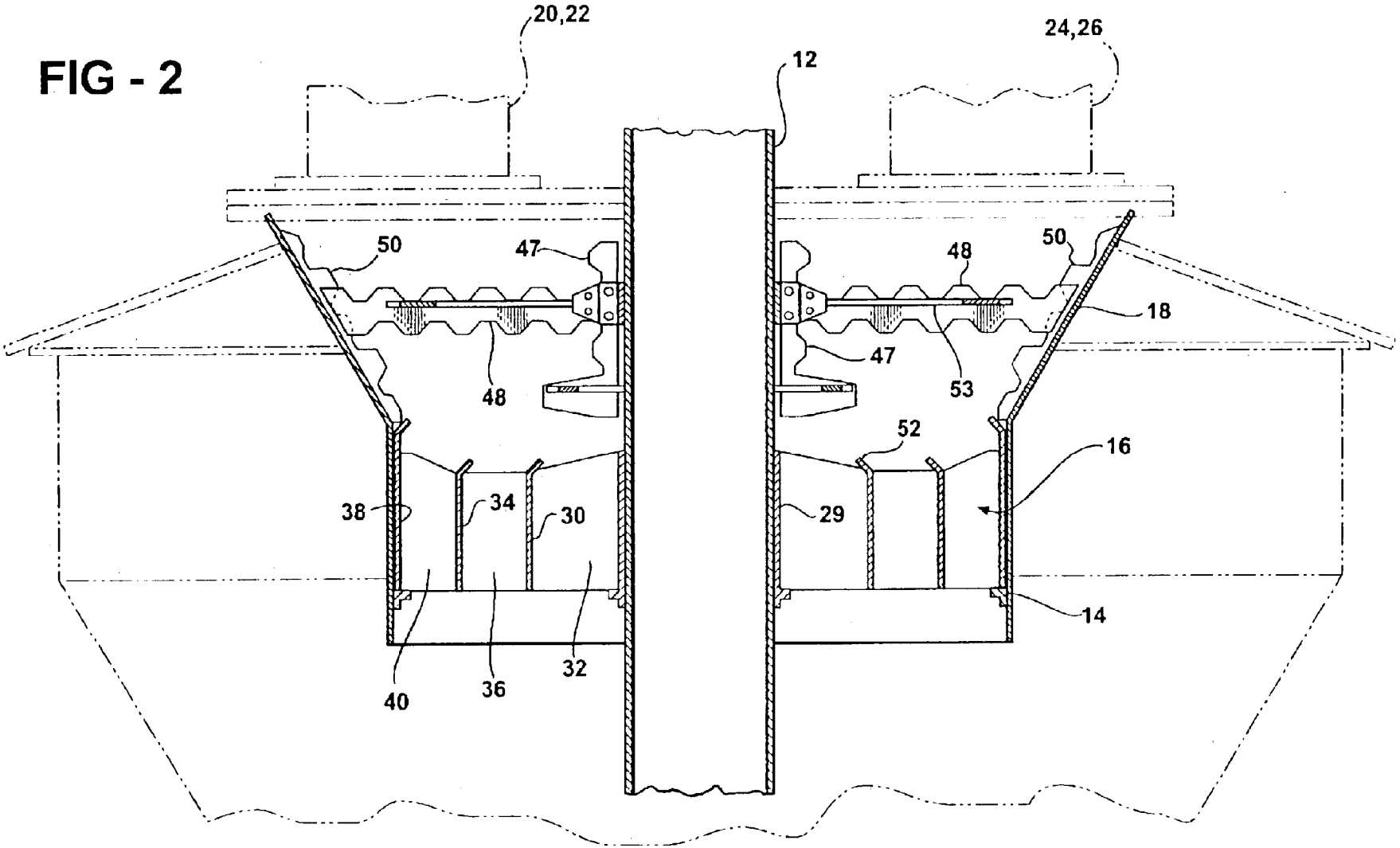
FIG. 2 is a cross-section through the mixer portion of the system of FIG. 1.
Figure 3:
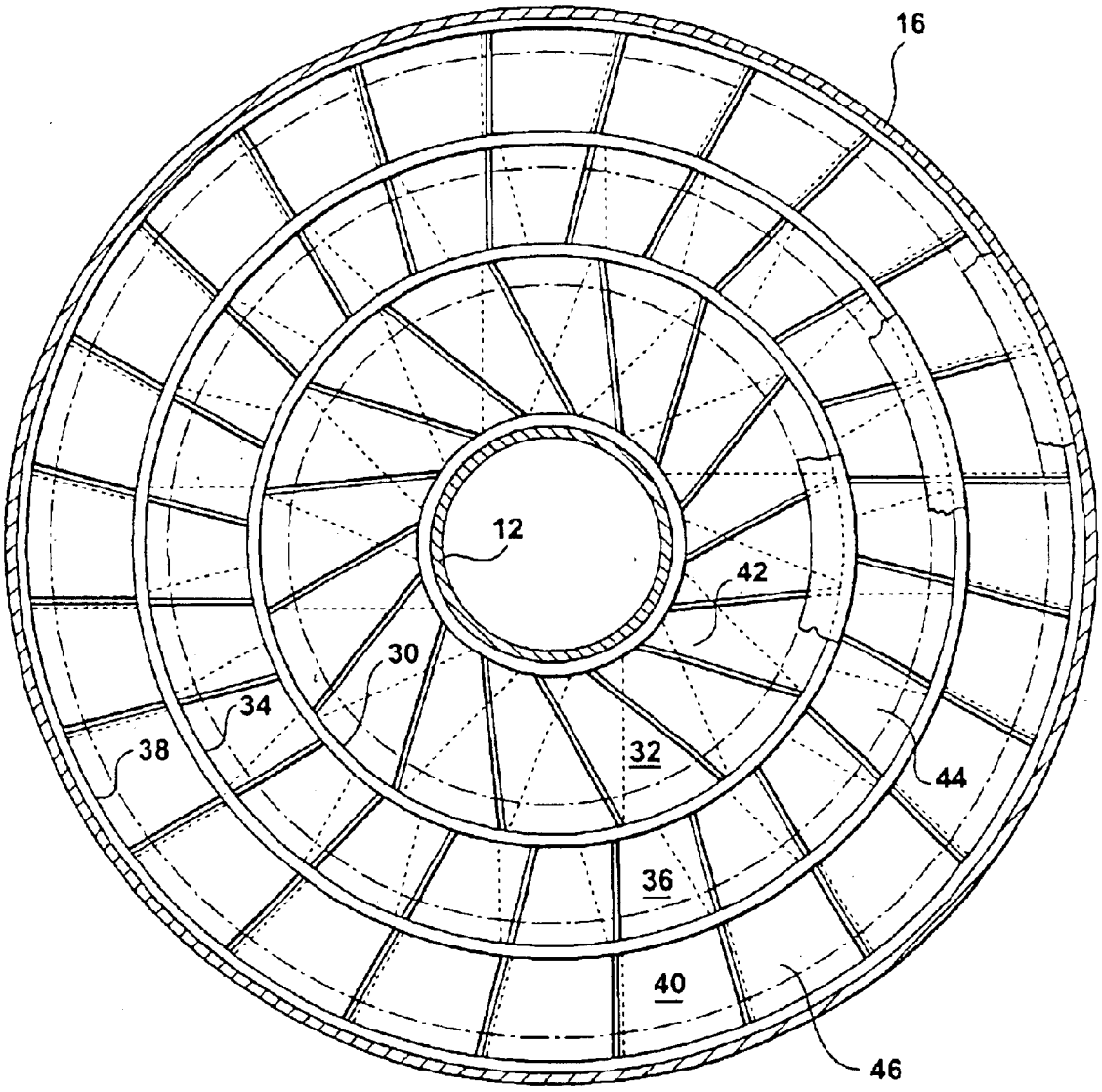
FIG. 3 is a plan view of the mixer showing the three concentric annular channels thereof.
Figure 4:
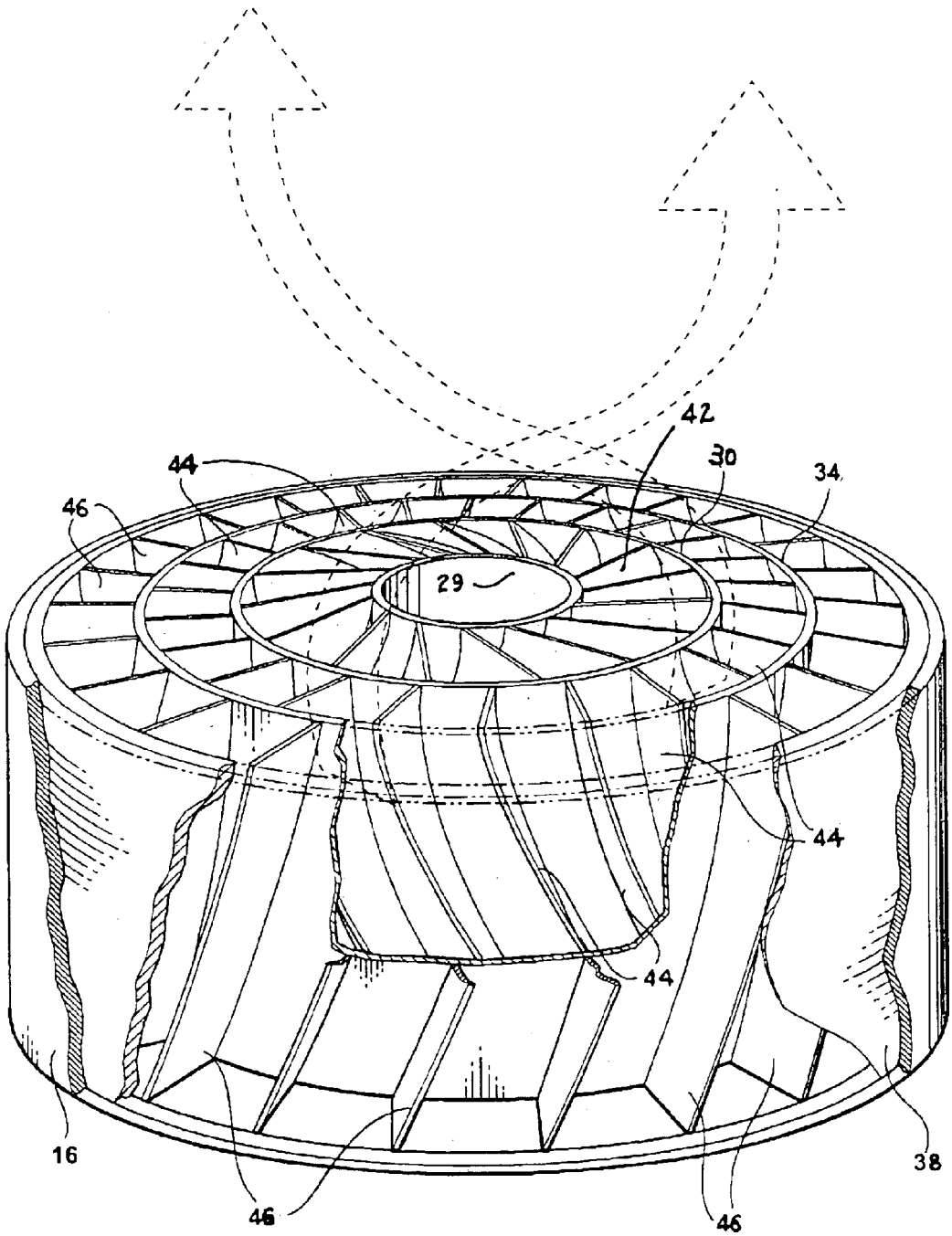
FIG. 4 is a cutaway of a mixer showing the opposite sense of rotation between an inner channel and an outer channel in schematic fashion.

Referring to FIGS. 2–4, the mixer insert 16 is mounted in the main outlet supply conduit 14 by means of flanges and other mechanical assemblies not shown in detail and comprises a pair of radially spaced cylindrical walls 29 and 30 to define a first annular channel 32 for the upbound flow of particulate airborne coal. A third cylindrical wall 34 concentric with the wall 30 and the conduit 12 is mounted in coplanar and surrounding relationship to the wall 30 to define a second annular channel 36. A fourth cylindrical wall 38 is mounted concentric and coplanar with the walls 29, 30 and 34 to define a third annular channel 40 for airborne particulate coal. In the arrangement shown in FIG. 2, channel 32 is referred to as the "inner" channel, channel 36 is referred to as the "intermediate" channel, and channel 40 is referred to as the "outer" channel. Obviously, these names can be interchanged or varied according to how many concentric channels there are in a particular embodiment of the invention. To fit the mixer 16 around the conduit 12, it may be necessary to make the mixer 16 in two mirror-image sections and bolt them together around conduit 12. The walls 29, 30, 34 and 38 may be slightly frustoconical if desired.

As better shown in FIGS. 3 and 4, vanes 42 are welded between walls 29 and 30 to impart a clockwise rotation or spin to the airborne particulate coal flowing through the upbound channel 32. Vanes 44 are mounted such as by welding between the walls 30 and 34 to impart a counterclockwise spin to the upbound airborne particulate coal flowing through channel 36. Vanes 46 are mounted such as by welding between the walls 34 and 38 to impart a clockwise spin to the upbound airborne particulate coal flowing through channel 40. It will be understood that the terms "clockwise" and "counterclockwise" are used in a relative sense. The vanes as shown in FIGS. 3 and 4 are all angled relative to a longitudinal axis sufficiently to overlap in plan or projected view so as to eliminate any straight-through paths for the airborne particulate coal flowing through the channels 32, 36 and 40. Annular kicker plates 52 are mounted on the tops of the walls 30, 34 and 38 to deflect the airborne particulate coal back inwardly toward the center of the assembly. The plates 52 are optional.

As best shown in FIGS. 2 and 3, radial spacing between wails 29 and 30 is greater than the radial spacing between the walls 30 and 34, and the radial spacing between walls 30 and 34 is greater than the spacing between walls 34 and 38. The spacing is arranged in such a fashion that the cross-sectional areas of the channels 32, 36 and 40 are approximately the same.

As best shown in FIG. 2, dentillated steel plates 47, 48 and 50 are mounted in the transition section 18 to create turbulence and additional mixing in the airborne particulate coal which emerges from the mixer insert 16. The plates 47 are mounted essentially in parallel to the flow axis. Plates 50 are mounted around the outside wall of the transition section 18. Radial plates 48, also of a dentillated design, are disposed on plates 53 running radially outwardly from the plates 47. These plates may be arranged in various fashions as is more completely described in my previously issued patents as set forth above. The plates 47, 48, 50 and 53 are an optional feature of the illustrated embodiment; i.e., the mixer 16 can be used with or without the additional turbulence-causing plates in the transition section 18.

In operation, lump coal is gravity fed through the inlet supply conduit 12 to the pulverizer/classifier 10 which operates in a conventional fashion. Pulverized coal is carried upwardly in an air stream through the main supply conduit 14 into the mixer insert 16 where the opposite sense spins are imparted to the three divided concentric annular flow quantities by the vanes 42, 44 and 46 disposed in the channels 32, 36 and 40. The spinning airborne particulate coal then encounters the transition section and the various means 47, 48 and 50 therein where it is turbulently intermixed before entering the four parallel branch conduits 20, 22, 24 and 26. Those conduits supply the four corners of the combustion chamber or "firebox" 28 of the turbine boiler.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A passive mixer for pre-crushed coal flowing to a coal-fired combustion chamber supply conduit comprising:

a plurality of substantially concentric stationary walls defining at least an outer annular flow channel and an inner annular flow channel;

a first plurality of circumferentially spaced stationary vanes mounted in the outer flow channel to and between two of said plurality of concentric walls and oriented to impart a clockwise spin to airborne particulate coal flowing axially therethrough; and a second plurality of circumferentially spaced stationary vanes mounted in the inner flow channel to and between another two of said concentric walls and oriented to impart a counterclockwise spin to airborne particulate coal flowing axially therethrough.

2. A mixer as defined in claim 1 wherein the cross-sectional areas of the inner and outer annular flow channels are approximately equal.

3. A mixer as defined in claim 1 wherein the walls are cylindrical.

4. A mixer as defined in claim 1, further comprising:

means, mounted on each of the plurality of substantially concentric walls, for deflecting airborne particulate coal inwardly toward a longitudinal axis of rotation.

5. A mixer as defined in claim 4 wherein the deflecting means comprises an annular kicker plate mounted at a downstream end of each of the plurality of substantially concentric walls.

6. A system as defined in claim 1 wherein at least one of the first plurality of circumferentially spaced vanes and the second plurality of circumferentially spaced vanes is angled relative to a longitudinal axis sufficiently to overlap in plan or projected view so as to eliminate any straight-through paths for the airborne particulate coal flowing respectively through at least one of the outer annular flow channel and the inner annular flow channel.

7. A passive mixer for pre-crushed coal flowing a coal-fired combustion chamber via multiple, parallel supply conduits comprising:

a plurality of substantially concentric stationary cylindrical walls defining at least an inner annular flow channel, an intermediate annular flow channel and an outer annular flow channel;

a plurality of circumferentially spaced stationary vanes mounted in each of the inner and outer flow channels and between the walls defining said channels and oriented to impart a clockwise spin to airborne particulate coal flowing axially therethrough; and a plurality of circumferentially spaced stationary vanes mounted in the intermediate flow channel to and between two of said walls and oriented to impart a counterclockwise spin to airborne particulate coal flowing axially therethrough.

8. A mixer as defined in claim 7 wherein the cross-sectional areas of the inner, intermediate and outer flow channels are approximately equal.

9. A mixer as defined in claim 7, further comprising:

means, mounted on each of the plurality of concentric cylindrical walls, for deflecting airborne particulate coal inwardly toward a longitudinal axis of rotation.

10. A mixer as defined in claim 9 wherein the deflecting means comprises an annular kicker plate mounted at a downstream end of each of the plurality of concentric cylindrical walls.

11. A mixer as defined in claim 7 wherein each of the plurality of circumferentially spaced vanes in each of the inner and outer flow channels is angled relative to a longitudinal axis sufficiently to overlap in plan or projected view so as to eliminate any straight-through paths for the airborne particulate coal flowing respectively through each of the inner and outer annular flow channel; and wherein each of the plurality of circumferentially spaced vanes in the intermediate flow channel is angled relative to the longitudinal axis sufficiently to overlap in plan or projected view so as to eliminate any straight-through paths for the airborne particulate coal flowing through the intermediate flow channel.

12. A system for supplying airborne particulate coal to a combustion chamber comprising:

a flow conduit;

a source for supplying said conduit with airborne particulate coal under pressure to cause flow through the conduit;

mixer means in said conduit comprising a plurality of substantially concentric walls defining at least an outer annular flow channel and an inner annular flow channel;

a first plurality of circumferentially spaced stationary vanes in the outer flow channel oriented to impart a clockwise spin to airborne particulate coal flowing therethrough; and a second plurality of circumferentially spaced stationary vanes in the inner flow channel oriented to impart a counterclockwise spin to airborne particulate coal flowing therethrough.

13. A system as defined in claim 12 wherein the cross-sectional areas of the inner and outer annular flow channels are approximately equal.

14. A system as defined in claim 12 further comprising means for imparting a turbulence to airborne particulate coal downstream of the mixer means.

15. A system as defined in claim 14 wherein the means for imparting turbulence comprises a plurality of dentillated plates mounted in various orientations within a flow channel receiving airborne particulate coal from the mixer means.

16. A system as defined in claim 12 further comprising a combustion chamber and a plurality of branch conduits connected between the mixer means and the combustion chamber for supplying airborne particulate coal through spaced points around the combustion chamber.

17. A system as defined in claim 16 wherein there are two or more essentially uniformly spaced and parallel branch conduits.

18. A system as defined in claim 12, further comprising:

means, mounted on each of the plurality of substantially concentric walls, for deflecting airborne particulate coal inwardly toward a longitudinal axis of rotation.

19. A system as defined in claim 18 wherein the deflecting means comprises an annular kicker plate mounted at a downstream end of each of the plurality of substantially concentric walls.

20. A system as defined in claim 12 wherein at least one of the first plurality of circumferentially spaced vanes and the second plurality of circumferentially spaced vanes is angled relative to a longitudinal axis sufficiently to overlap in plan or projected view so as to eliminate any straight-through paths for the airborne particulate coal flowing respectively through at least one of the outer annular flow channel and the inner annular flow channel.

* * * * *